United States Patent [19]

Lubrich et al.

[11] Patent Number: 4,486,049

[45] Date of Patent: Dec. 4, 1984

[54] HEAVY BREAKING GIANT EXCAVATING EQUIPMENT

[75] Inventors: Wolfgang Lubrich, Bad Schwartau; Dieter Hoffmann, Lübeck, both of Fed. Rep. of Germany

[73] Assignee: O & K Orenstein & Koppel Aktiengesellschaft, Dortmund, Fed. Rep. of Germany

[21] Appl. No.: 412,927

[22] Filed: Aug. 30, 1982

[30] Foreign Application Priority Data

Aug. 29, 1981 [DE] Fed. Rep. of Germany ..... 3134642

[51] Int. Cl.[3] ..... E21C 47/00

[52] U.S. Cl. ..... 299/7; 299/18; 414/565

[58] Field of Search ..... 299/7, 9, 18, 67; 414/565-567; 198/587

[56] References Cited

U.S. PATENT DOCUMENTS

| | | | |
|---|---|---|---|
| 991,083 | 5/1911 | Perry | 299/7 |
| 1,162,607 | 11/1915 | Hoar | 414/565 |
| 3,040,918 | 6/1962 | Schwartz et al. | 414/567 X |
| 3,926,301 | 12/1975 | Herms | 198/509 |
| 3,959,897 | 6/1976 | May | 299/18 X |

*Primary Examiner*—Ernest R. Purser

[57] ABSTRACT

Heavy breaking giant excavator having a mining system with the following components: a boom having a feed chute and conveyor equipment at one end thereof; and sifting, crushing, and transfer equipment at the other end thereof, and a dipper boom arrangement is disposed on the end of the vertically supported, swivellable boom onto which mined material is fed. The dipper boom has a limited hydraulic capacity dipper disposed thereon.

7 Claims, 1 Drawing Figure

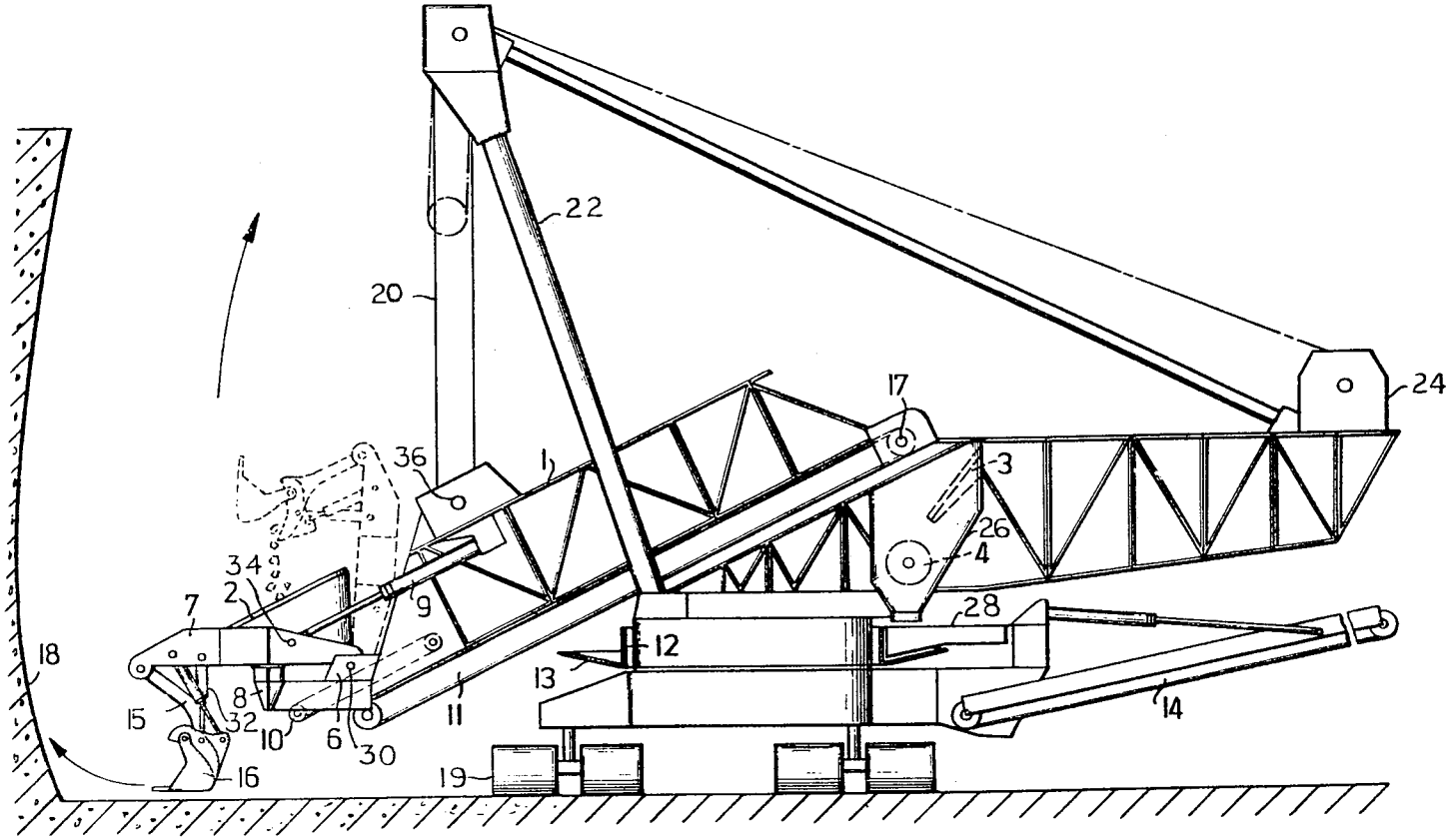
24
14
3
26
4
28
17
12
13
22
1
11
19
20
36
9
30
6
10
34
2
8
32
16
7
15
18

HEAVY BREAKING GIANT EXCAVATING EQUIPMENT

The invention relates to Heavy Breaking Giant Excavating Equipment having a mining system with the following components: a boom having a feed chute and conveyor equipment at one end thereof, and sifting, crushing, and transfer equipment at the other end thereof.

Large-size bucket wheel excavators have proven themselves in many applications in strip mining operations. However, their use is limited to the circumstances where the material to be mined is relatively hard and strong. In these cases the application of special equipment becomes necessary.

Gallery excavators, with a dipper arrangement attached to boom conveyors which are height adjustable and laterally moveable, are known. In these excavators, the dipper is equipped with impact teeth (rams) protruding from the cutting edge thereof (DRP No. 560 030). Such an arrangement facilitates the mining of extremely hard coal but it is not suitable for stripping stratified layers of rock.

The object of this invention is to facilitate stripping in a strip mining operation, even if, there are layers of fissured rock beds, when individually selected ore or coal beds or veins are to be stripped. The invention according to the description as described at the introduction: the dipper stick has a limited hydraulic capacity excavating arrangement which is disposed at the feed end of the vertically supported, swivellable boom. The stripping system, with its components, according to this invention, therefore assures stripping even when rock beds, e.g. sandstone or marl veins, appear in the region to be stripped, and even, if these rock beds are layered with fissures, or even, if coal veins, which are relatively thin, are to be mined. At the same time, the mined material is prepared for transportation by conveyor belt, so that, the connecting conveyor belt can bridge the substantial differences of levels which presently are quite common in strip mining.

A schematic exemplary embodiment of the invention is explained with the aid of a drawing:

In the drawing, a large scale excavator is shown with its main boom 1 moveable on an undercarriage with, for example, tracks; a feed chute 2 and conveying equipment. A first conveyor stage 10 receives stripped material from the region below the hopper of the feed chute 2 whereby a second conveyor stage 11 takes over the transportation to sifting devices 3 and crushers 4. The material flow then goes to a ring conveyor 12, and yet further, a transfer feed conveyor 14 is provided. The drawing shows that the dish-like surface 13 of the ring conveyor 12 does not have a rim. The dish surfaces form an acute angle which is open towards the top. This arrangement avoids frictional loss and wear on the parts thereof.

On the feed end of the swivellably, supported main boom 1, a dipper stick 7 is arranged having limited load capacity hydraulic excavating equipment disposed thereon. The equipment comprises a dipper support member 15 and a dipper 16 in addition to the dipper stick.

The hydraulic driven excavating equipment is designed in such a way that the hydraulic cylinder of the dipper stick is supported by the main boom. In order for the shovel to be able to generate sufficient breaking torques, the dipper stick is supported, at least, at one end position thereof by a support 8 disposed on the main boom.

The main boom 1 is not only supported vertically swivellable about pivot 17, but is also arranged to be slideable along the boom axis in both a forward and reverse direction.

During the stripping of large areas, the boom is rotatable in a known manner by means of the live ring common to any of the giant size excavators. Because of the aforementioned forward and reversed slideability of the boom, it is possible therefore to provide smooth stripped surfaces. Also, the height of the schematically shown stripped bank 18 can be very substantial with this illustrated arrangement.

We claim:

1. In a heavy breaking giant excavator having a main boom with a feed chute and conveyor equipment at one end thereof and sifting, crushing and transfer equipment operatively associated with the other end thereof, the improvement comprising an excavating apparatus operably associated with said main boom and disposed proximate said feed chute, said excavating apparatus being movable from a first position for excavating and collecting material, to a second position for disposing of said excavated and collected material into said feed chute.

2. The improved excavator according to claim 1 wherein the main boom includes a dipper stick supported thereon by a support bracket and wherein the excavating apparatus is operably associated with said main boom by means of said dipper stick.

3. The improved excavator according to claim 2 wherein a hydraulic cylinder is operably associated with the dipper stick and the main boom for effecting movement between the first and second positions of the excavating apparatus.

4. The improved excavator according to claim 1 wherein the conveyor equipment of the main boom is a multi-stage arrangement.

5. The improved excavator according to claim 4 wherein the multi-stage arrangement includes a first conveyor stage which receives mined material from below the feed chute and a second conveyor stage which cooperates with the said first stage to further transport the mined material to the sifting and crushing devices.

6. The improved excavator according to claim 1 wherein the main boom is vertically supported and swivellable relative to the giant excavator and said main boom is slidable in a forward and reverse direction along the level of said main boom.

7. The improved excavator according to claim 1 wherein the transfer equipment associated with the main boom of the giant excavator includes a ring conveyor system operably associated with said giant excavator, said ring conveyor having a dish surface defining an acute angle which opens upwardly, said ring conveyor system being disposed along the direction of flow of the mined material.

* * * * *